United States Patent [19]

Flesher et al.

[11] Patent Number: 5,002,607

[45] Date of Patent: Mar. 26, 1991

[54] PROCESS FOR PELLETIZING PARTICULATE MATERIALS

[75] Inventors: Peter Flesher; John R. Field, both of West Yorkshire, England

[73] Assignee: Allied Colloids Ltd., England

[21] Appl. No.: 458,234

[22] Filed: Dec. 28, 1989

[30] Foreign Application Priority Data

Dec. 30, 1988 [GB] United Kingdom ..... 8830383

[51] Int. Cl.[5] ..... C22B 1/16; C22B 1/244

[52] U.S. Cl. ..... 75/772; 75/767; 427/221; 524/447

[58] Field of Search ..... 75/767 US, 772 US; 427/221; 524/447; 106/214, 163.1

[56] References Cited

U.S. PATENT DOCUMENTS

| | | | |
|---|---|---|---|
| 3,860,414 | 1/1975 | Lang et al. | 75/772 |
| 4,684,549 | 8/1987 | Allen et al. | 75/772 |
| 4,728,537 | 3/1988 | Allen et al. | 75/772 |

*Primary Examiner*—Melvyn J. Andrews

*Attorney, Agent, or Firm*—Ostrolenk, Faber, Gerb & Soffen

[57] ABSTRACT

Particulate metal ore is pellitized by use of a novel polymeric binder that comprises aggregates of polymer particles and that have a size mainly above 100 μm and the aggregates are disintegrated during the process.

18 Claims, No Drawings

PROCESS FOR PELLETIZING PARTICULATE MATERIALS

It is common practice to convert a mass of particulate metal ore material into pellets by distributing a binder throughout the particulate ore in the presence of an activating amount of water to form a homogeneous moist pelletisable mixture and pelletising this mixture, generally by balling or other conventional pelletising techniques. The strength of the pellets is generally improved by firing the pellets.

The binder has traditionally been bentonite clay but various proposals have been made to use organic polymeric binders. Naturally occurring polymers have been proposed, including cellulose polymers sold under the trade name Peridur, but they are not entirely satisfactory and, in particular, it can be rather difficult to regulate accurately their addition to the particulate material. Synthetic polymers have also been proposed for very many years but their use also has incurred difficulties. For instance, recently it is proposed in U.S. Pat. Nos. 4,767,449 and 4,802,914 to use dispersions or dry polymers alone or with bentonite, and included amongst the polymers that are proposed are certain anionic dry polymers (table 2 column 14 U.S. Pat. No. 4,767,449). The materials listed there under the trade name Percol have relatively high particle size, for instance above 700 μm. The results obtainable with large particle size products such as these are not entirely satisfactory and in particular there is a tendency for the resultant pellets to be contaminated by dust that is stuck to the surface of the pellets and which is then blown off the pellets during the subsequent metallurgical use of them. This dusting problem is thought to be due to the pellets having a surface that is stickier than desirable. Whatever the cause, the pellets suffer from the disadvantage that when air is blown through a bed of them metal ore dust is entrained in the air and carried out of the furnace. This can create undesirable pollution problems and undesirable wear on blowers and other parts of the furnace and apparatus associated with the furnace.

In EP Nos. 225,171 and 288,150 particular synthetic polymers are proposed and dry particles of these polymers should have a size of from 20 to 300 μm, often at least 50% below 100 μm.

The use of these smaller particles tends to give improved pelletising performance (including reduced dusting problems) but does incur some handling problems. If the particles are in the form of beads made by reverse phase polymerisation there is a tendency for them to be contaminated by materials that may alter the surface tension of the particles, and potentially therefore their pelletising performance. Generally therefore the particles are comminuted gel particles. However handling the very small comminuted gel particles can itself cause difficulties partly because of the risk of polymer fines being blown from the mixing stage and partly because the flow properties of the particles are not entirely satisfactory and so accurate dosing of the particles into the particulate material can be difficult.

According to the invention, pellets of a particulate metal ore are made by distributing a binder comprising water soluble polymer particles throughout the particulate ore in the presence of an activating amount of water to form an initial mix, homogeneously mixing the initial mix to form a moist pelletisable mixture and pelletising the pelletisable mixture, and in this process the binder comprises aggregates of the polymer particles, the aggregates have a size mainly above 100 μm and the aggregates are disintegrated during the process.

The invention combines the advantages of the use of very small polymer particles, from the point of view of pelletising performance and minimisation of dust problems, with the easier handling properties associated with the use of large polymer particles. The pellets can have a more uniform shape in the invention than when using other polymer binders.

Handling of the polymeric binder is greatly facilitated (relative to the handling properties of the particles) since the coarse aggregates can be handled more easily to obtain more uniform flow and with a minimum of dusting problems. However this improved handling is not accompanied by a loss of binding properties. This appears to be because the aggregates break down during the mixing, mainly into the component particles, and the binding properties are then influenced to a large extent by these component particles rather than the initial aggregates. Thus it is possible to select aggregates of a size that give optimum handling and flow properties and which are formed from particles that are of a size that give optimum binding properties.

Since the aggregates are disintegrated during the process, bonding performance in the pellets does not suffer from the normal disadvantages of large polymer particles, and in particular it is possible to avoid the sticky surface characteristics, and consequential dusting problems, conventionally associated with the use of large polymer particles. The pelletising properties are generally therefore at least at good as the pelletising properties that would be expected if the constituent particles of the aggregates had been added in conventional particulate form, but in practice we find that in many instances the pelletising properties are improved even over this. For instance the dry strength is frequently improved both over the dry strength that would be expected for single particles having the size of the aggregates and over the dry strength that would be expected from the individual particles in the aggregates.

The aggregates must be disintegrated during the process in order that the constituent polymer particles are distributed throughout the moist mixture and can act homogeneously as a binder throughout the mixture. Although some of this disintegration may occur very soon after the start of mixing, we have found that the performance is often improved if the disintegration is substantially delayed, and in particular it is desirable that most at least of the disintegration is delayed until after the binder has been distributed substantially uniformly throughout the initial mix. Having achieved this substantially uniform distribution of aggregates throughout the mix, further mixing is conducted in conventional manner so as to achieve the desired homogeneous, moist, pelletisable mixture. In practice, it is conventional to use a single mixing operation, wherein the early stages of the mixing achieve the distribution of the binder substantially uniformly throughout the initial mix, and the later stages of the mixing achieve the desired homogeneous mixture. Thus the ideal mechanism appears to be that the aggregates should become mixed substantially uniformly into the mass whilst still retaining most of their aggregated form, and that they should distintegrate only after they have become substantially uniformly mixed into the mass. Thus typically the aggregates should still be visible to the eye as aggregates (even though some particles may have been removed from them) at a time when they can be seen to be uniformly mixed throughout the mass. The mixing is normally conducted only for the duration necessary to provide the homogeneous mixture of the binder and the particles and so preferably the aggregates are disintegrated into the metal ore particles mainly during the last third of the mixing.

The rate of disintegration into the particles during the mixing depends partly upon the nature and content of the mass and partly upon the hardness and rate of water uptake of the aggregates. In particular, the hardness of the aggregates should be optimised, having regard to any particular particulate ore, so that the aggregates disintegrate into the mixture at the optimum time for that particular ore. It is therefore necessary to ensure that the particles in the aggregates are bonded to one another sufficiently strongly that the aggregates do not disintegrate substantially during normal handling or too early in the mixing process, but the bonding must not be so strong that the aggregates are non-friable and do not disintegrate during the mixing. The desired strength of aggregates for any particular process can be selected by routine optimisation of the aggregating materials and conditions.

The dry interaction that can result in loose clustering of comminuted polymer fines is not sufficient to form aggregates for the invention since they will break significantly during normal handling to cause dusting problems.

Friable products can be made by dry compression of particles, but it is rather difficult to make, by this technique, aggregates having an appropriate size and structure for use in pelletising. Preferably therefore the aggregates are normally made by bonding the polymer particles by wetting them with an aqueous liquid to render them adhesive and then aggregating the particles while they are adhesive. Preferably the aggregates have a porous texture and so should not be compressed significantly while adhesive. Preferably no deliberate compression step is applied while they are tacky. For instance the particles may be wetted with the aqueous liquid while entrained in air or carried along a surface and may, if necessary, be comminuted to aggregates of the desired size. Suitable apparatus of this type is a spray mix or fluid bed blender and aggregator. In another method, the polymer particles are stirred with the aqueous liquid to form an adhesive mass and this is then comminuted, for instance by extrusion through a screen. The comminution steps can be conducted while the mix is moist but often it is best to dry the mass and then comminute any oversize pieces in the mass, e.g., by attrition or sieving.

The fact that the particles have been aggregated using an aqueous liquid can be seen easily by microscopic examination. The use of the aqueous liquid causes adjacent particles to merge into each other and tends to remove the sharp contours that fines normally have.

The aqueous liquid may solubilise the polymeric particles sufficiently to render them adhesive by solubilisation of the surfaces of the particles. The liquid can consist of water but it can be desirable for this liquid to be an emulsion of water in a water immiscible liquid, such as kerosene, or to be an aqueous solution in a polar solvent such as aqueous methanol, ethanol, isopropanol or acetone.

The amount of water is selected so as to give the desired degree of adhesiveness. If too much water is applied the aggregates may become firmly bonded and hard. If too little is used, the aggregates may break down too easily. Generally the amount of water is at least 10%, usually at least 30%, on dry weight of polymer, but is generally below 120% and often below 80%.

As explained below, the aggregates preferably include also a secondary material that is not a soluble polymer. In some instances, especially when the aggregates contain a large amount of such a material, mere solubilisation of the surfaces of the soluble polymer particles may be inadequate to provide sufficient adhesiveness for bonding the particles within the aggregate. It is then desirable to include an additional bonding agent within the aqueous liquid.

The aggregate bonding agent that is included in this manner is generally a water soluble polymer which is preferably non-ionic and can be a natural polymer, such as a starch or cellulosic polymer, or can be a synthetic polymer, such as polyvinyl alcohol.

The bonding agent can be ionic, but if the polymer particles are of an ionic polymer then any ionic aggregate bonding agent should be co-ionic. For instance if the polymer particles are anionic then the aggregate binder is preferably a low molecular weight (e.g., below 50,000 and often below 10,000) anionic polymer such as sodium polyacrylate. If the polymer particles are of a cationic polymer then any ionic bonding agent is preferably a low molecular weight cationic polymer such as a polyamine. In general, anionic and cationic aggregate bonding agents can be formed from anionic and cationic monomers, usually blended with non-ionic monomer, selected from the same monomers as are discussed below for the polymer particles. If aggregate bonding agent is included, its amount is usually below 10%, frequently 0.05 to 1% based on the weight of aggregate.

The aggregates are generally rendered substantially non adhesive and dry during or after their formation, for instance by drying sufficiently to drive off the water, but in some instances it is convenient to form the aggregates at the point of use and to mix the moist aggregates into the particulate metal ore without prior evaporation of all the water.

The water soluble, particulate polymer that is in the form of aggregates can be a natural or modified natural polymer such as a starch or cellulose, for instance carboxy methyl cellulose polymer, or may be a synthetic polymer, for instance formed from a water soluble ethylenically unsaturated monomer or monomer blend. Generally it is an ionic synthetic polymer formed from anionic or cationic monomer, optionally with a non-ionic monomer. It may be amphoteric, being formed from a mixture of cationic and anionic monomers, optionally with non-ionic monomer.

Suitable anionic monomers are ethylenically unsaturated carboxylic acids or sulphonic acids, often in the form of a water soluble ammonium or, preferably, alkali metal salt. Suitable carboxylic acids are methacrylic, itaconic, maleic or, preferably, acrylic acid. Suitable sulphonic acids include allyl, methallyl, vinyl and 2-acrylamido-2-methyl propane sulphonic acids, usually as alkali metal salt.

Suitable cationic monomers include dialkylaminoalkyl (meth) -acrylamides and -acrylates, usually as acid addition or quaternary ammonium salts, and monomers such as diallyl dimethyl ammonium chloride.

Suitable non-ionic monomers include methacrylamide and acrylamide.

The polymer is normally unreactive but can include groups that will cause cross linking, for instance methylol acrylamide groups or it can be promoted by the addition of glyoxal under appropriate conditions. The polymer can include a mixture of water soluble cationic and water soluble anionic polymers in dry form since the mixture will be stable when dry but will react to insolubilise the polymer when wet. Thus aggregates of anionic polymer may be mixed dry with aggregates of cationic polymer.

The molecular weight of the polymer will normally be selected so that the polymer has the desired binding properties, and thus normally the molecular weight is above 1 million. The intrinsic viscosity is generally above 2 or 3 dl/g, and often above 4 dl/g. When the polymer is cationic, values of up to 12 or 15 dl/g are usually adequate but when the polymer is non-ionic or anionic values of up to 25 or 30 dl/g may be used. However the preferred materials are anionic polymers made from a water soluble blend of non-ionic ethylenically unsaturated monomer (generally acrylamide) and ethylenically unsaturated carboxylic monomer. The amount of this monomer is generally in the range 5 to 30 or 40%, preferably 5 to 20%, by weight of total monomers. The polymer preferably has intrinsic viscosity of from 2 to 16 dl/g, and for most purposes an intrinsic viscosity of about 2 to 6 dl/g is very satisfactory although values in the range of 3 to 10 dl/g can also give useful results.

Although the polymer particles can have a size up to, for instance, 500 μm, they are usually mainly below 300 μm and most usually mainly below 200 μm and often mainly below 100 μm, e.g., at least 90% below 200 μm and at least 40% below 100 μm. Generally they are at least 10 μm, but they can be smaller, e.g., 1 μm or less.

The polymer particles can have been made by any convenient polymerisation technique including precipitation polymerisation or solution polymerisation, but generally will have been made by gel polymerisation or reverse phase polymerisation. Preferred particles are those that have been made by gel polymerisation followed by comminution, for instance in conventional manner. The particles may be the entire product of the comminution (thus generally including a spread of particle sizes) or they may be a narrow fraction sieved from the entire product (for instance being the finer particles separated from the comminuted product).

The aggregates can be formed solely from the polymer particles and optionally bonding agent but it is frequently desirable to include a secondary material in the mix that is to be aggregated. This material can modify the performance of the aggregates and can facilitate the production of aggregates of any desired size by facilitating the comminution of the adhesive mass into the desired aggregates. In particular the secondary material can be a disintegrating aid for promoting disintegration of the aggregates. This disintegrating aid can be a water insoluble particulate material that will prevent the polymer particles bonding too strongly to each other and so will promote disintegration. Examples include coal, coke, fine metals, limestone, dolomite and clays, provided that the clay does not have a structure such that the polymer penetrates firmly into the clay. Generally however the disintegrating aid is highly water soluble, in the sense that, when the aggregate is contacted with water, the disintegrating aid will dissolve faster than the polymer particles. Particulate secondary material will usually be below 150 μm and will usually be smaller than the polymer particles.

When pelletising metal ore with a polymeric binder, it is well known to include a pelletising aid. Preferably such a material is used in the invention as part of the binder. The pelletising aid is normally a water soluble, monomeric material and suitable materials are described in EP Nos. 225,171 and 288,150 and in U.S. Pat. Nos. 4,767,449 and 4,802,914. Generally the materials are selected from sodium carbonate, sodium bicarbonate, sodium silicate, sodium phosphate, sodium stearate, sodium benzoate, sodium tartrate, sodium oxylate, sodium citrate, sodium acetate, the corresponding ammonium, potassium, calcium and magnesium salts of the preceding sodium salts, urea and calcium oxide, preferably sodium carbonate.

Sodium carbonate or other such pelletising aid can thus be included in the aggregates so as to promote disintegration of the aggregates in the presence of water. Additional pelletising aid can be added to the particulate metal or separately. However it is particularly preferred in the invention to include particulate pelletising aid in the aggregates since this facilitates the production of aggregates having the desired friability and flow properties, provides a homogeneous storage stable product and results in easy and simultaneous addition of the particulate binder and the pelletising aid. If attempts are made merely to admix preformed aggregates to the polymer particles with particulate pelletising aid, there is a tendency for the pelletising aid to separate from the polymeric aggregates during transport and storage, and this is avoided by forming the aggregates from a mixture of the pelletising aid and the polymeric particles.

Typical content of the aggregates is about 50 to 90% by weight of the water soluble polymer, about 95 to 10% by weight of the pelletising aid and 0 to 10% by weight of the aggregate bonding agent, but when, as is preferred, the aggregates contain substantially all the pelletising aid that is required for the pelletisation then preferred proportions are about 40 to 70% polymer, about 60 to 30% pelletising aid and 0 to 10% aggregate bonding agent.

The aggregates must have at least 90% above 100 μm since otherwise their use will be accompanied by the problems of flow and dusting of fine polymer particles, and will generally be above 300 μm. At these relatively small sizes, the use of aggregates still gives significant advantages over the use of the component, smaller, polymeric particles, but the invention is of particular value when the aggregates are substantially all above 500 μm, for instance 90% above about 500 μm, in which event the polymer particles are preferably substantially all below 300 μm. If the aggregates are too large, uniform mixing of them into the mass may be difficult and so they are usually below 5 mm, or at the most 10 mm, in size. Aggregates having a size of 700 μm to 3 mm are generally preferred.

It should be noted that aggregates suitable for use in the invention, and methods of making them and their use in iron ore pelletisation are also described in EP No. 326,382. This was published after the priority date of the present invention and its disclosure of aggregates for iron ore pelletisation has the same priority date, and is based on the same priority document, as the present application.

The binder may include polymer additional to the polymeric aggregates but generally the aggregates constitute at least 50% of the polymeric content of the binder. It is generally undesirable or unnecessary to make any deliberate addition of non-aggregated polymer particles and so preferably substantially all the polymer particles in the binder are present as the aggregates. Ideally therefore 100% by weight of the particles are provided as aggregates but of course these aggregates are likely to be contaminated with small amounts of free component particles and so generally at least 80% by weight of the polymer particles are provided as aggregates, i.e., at the time of addition of the binder to the particulate metal ore.

Other binder components can be included either in the aggregates or separately. For instance borax and/or sequestering agents such as ethylene diamine tetra acetic acid may be included, preferably in the aggregates, so as to improve performance in the presence of salts causing water hardness. Another way of achieving this is to include a sulphonated polymer, preferably 2-acrylamido 2-methyl propane sulphonate, as part or all of the anionic polymer.

It is sometimes desired to include bentonite as part of the binder. Although this could be included in the aggregates it is generally more preferred to keep it separate from the aggregates and to add it sequentially or simultaneously to the metal ore with the aggregates. The addition of bentonite with the aggregates gives better performance than the addition of bentonite with the constituent polymer particles of the aggregates. We believe that this is because the polymer particles and the aggregates absorb water from the particulate mixture more slowly than the constituent particles would, if they had been added in non-aggregated form, and that this slower absorption of water by the polymer particles allows the bentonite to be activated more efficiently by the moisture in the mix. The proportions of bentonite to polymer can be as described in U.S. Pat. No. 4,767,449.

The particulate metal ore generally is an iron ore or a titanium-bearing ore, but can be any metal ore that is capable of being pelletised. The moist pelletisable mixture must contain an amount of water that is appropriate for activation of the binder and, as is known, the optimum amount of water for this purpose will vary according to the nature of the ore and the pelletising and other process conditions. Generally it is in the range 5 to 15% by weight of the total mixture. Some or all of the water for this purpose may be added deliberately to the mixture but generally most or all of the moisture is introduced initially with the components of the mixture, in particular as a result of the use of damp particulate metal ore.

The pellets can be made by compression techniques but preferably are made by conventional techniques that do not involve compression such as the conventional tumbling, rolling or balling pelletising techniques. The particle size of the metal ore will be conventional for pelletisation and is typically below 100 μm, often mainly below 50 μm. The pellets are normally dried and fired, after manufacture and before use.

They can have conventional size for ore pellets.

In general, the pelletising techniques, materials and products may be conventional, for instance as in EP No. 225171, except that the binder is added in the form of the aggregates.

The following are some examples.

EXAMPLE 1

A copolymer of about 60% by weight acrylamide and 40% by weight sodium acrylate and having IV about 10 dl/g is formed by gel polymerisation and it was then dried and comminuted to particles 100% below 200 μm, in conventional manner. 250 g of these particles are mixed with 250 g sodium carbonate particles 100% below 200 μm in the bowl of a Hobart food mixer with various amounts of water and is stirred until the mass has a uniform friability. The amounts of water that are added ranged from 0.15 parts to 1 part per part by weight of polymer and sodium carbonate mixture and it is found that increasing the amount of water give stronger bonding of the aggregates.

The moist mixture is allowed to dry in air for two days and is then forced through a 2 mm sieve in order to break the brittle but friable product into aggregates to give a product 90% above 125 μm and 72% below 710 μm.

EXAMPLE 2

The process of example 1 is repeated but using copolymers of acrylamide and, respectively, 35%, 20% and 10% sodium acrylate with intrinsic viscosities of, respectively, about 6 dl/g, about 6 dl/g and about 3 dl/g.

EXAMPLE 3

The process of example 1 is repeated using a copolymer of 80% by weight acrylamide and 20% by weight sodium acrylate having intrinsic viscosity about 6 dl/g and the water used for bonding the particles included polyvinyl alcohol.

EXAMPLE 4

In processes according to the invention, aggregates made in preceding examples are scattered at a dose of 0.06% by weight on to a particulate iron ore concentrate having a moisture content of 9.3% and a particle size below 50 μm, are thoroughly mixed into the concentrate, and the blend is then converted to pellets in a balling drum and fired in conventional manner. In a comparison, the same iron ore concentrate has the same dosage of binder added to it but the binder is added in the form of the starting particles of sodium carbonate and the starting particles of polymer. In other processes, 0.04% of the aggregate and 0.2% bentonite are added together. In other processes the aggregates are not dried (thereby saving drying energy) prior to addition to the ore.

In all of the processes the addition of the aggregates is very much easier to perform from the point of view of flow and handling properties and minimisation of polymer dusting problems, relative to the use of the non-aggregated polymer particles.

In all processes, the amount of entrained iron ore particles in the air forced through a bed of the pellets, during firing, is observed. It is consistently seen to be satisfactorily low. However in a further comparison, where the polymer used in example 3 is introduced in the form of non-aggregated particles having a size above 500 μm a significant amount of metal ore dust is entrained by the air.

Typical results obtainable in this example are shown below, and demonstrate that the improved handling and reduced ore dusting advantages of the invention are associated with pelletising properties that are at least as good, and often better, than when the polymer is added in the form of free particles.

| Polymer | | | | | |
|---|---|---|---|---|---|
| % sodium acrylate | Ivdl/g | aggregated | Bentonite | Drop number | Dry strength |
| 20 | 6 | yes | yes | 10 | 5.3 |
| 20 | 6 | no | yes | 9 | 4.1 |
| 10 | 3 | yes | yes | 6 | 4.2 |
| 35 | 6 | yes | no | 7.4 | 7.8 |
| 35 | 6 | no | no | 8.4 | 2.8 |
| 35 | 6 | yes | no | 32.6 | 8.2 |
| 35 | 6 | no | no | 28.4 | 4.2 |

We claim:

1. A process in which pellets of a particulate metal ore are made by distributing a binder comprising water soluble polymer particles throughout the particulate ore in the presence of an activating amount of water to form an initial mix, homogeneously mixing the initial mix to form a moist pelletisable mixture and pelletising the pelletisable mixture, characterised in that the binder comprises aggregates of the polymer particles, the aggregates have a size mainly above 100 μm and the aggregates are disintegrated during the process.

2. A process according to claim 1 in which the binder also includes a pelletising aid.

3. A process according to claim 1 in which the binder includes a pelletising aid and this is included in the aggregates and is a water soluble monomeric compound that promotes disintegration of the aggregates in the presence of water.

4. A process according to claim 3 in which substantially all the pelletising aid is included in the aggregates in admixture with the polymer particles.

5. A process according to claim 2 in which the pelletising aid is selected from sodium carbonate, sodium bicarbonate, sodium silicate, sodium phosphate, sodium stearate, sodium benzoate, sodium tartrate, sodium oxylate, sodium citrate, sodium acetate, the corresponding ammonium, potassium, calcium and magnesium salts of the preceding sodium salts, urea and calcium oxide.

6. A process according to claim 1 in which the binder also includes bentonite.

7. A process according to claim 1 in which the aggregates have been formed by aggregation of the polymer particles in the presence of aqueous liquid substantially without the application of pressure.

8. A process according to claim 7 in which the aqueous liquid included water soluble polymeric bonding agent.

9. A process according to claim 7 in which the aggregates are added to the particulate ore substantially without intermediate drying.

10. A process according to claim 1 in which the aggregates are added to the particulate ore while dry.

11. A process according to claim 2 in which the aggregates are formed of 40 to 70% by weight of the polymer particles, 60 to 30% by weight pelletising aid and 0 to 10% by weight water soluble polymeric bonding agent.

12. A process according to claim 1 in which the aggregates are substantially all above 500 μm and are formed from polymer particles substantially all below 300 μm.

13. A process according to claim 12 in which the aggregates are substantially all 500 μm to 3 mm and are formed from polymer particles at least 90% below 200 μm and at least 40% below 100 μm.

14. A process according to claim 1 in which substantially all the water soluble polymer particles in the binder are added to the ore while in the form of the aggregates.

15. A process according to claim 1 in which the aggregates are disintegrated mainly after the formation of the initial mix.

16. A process according to claim 1 in which the water soluble polymer that is present as particles in the aggregates is selected from water soluble starches, water soluble celluloses and water soluble polymers of one or more ethylenically unsaturated monomers and having molecular weight of at least 1 million.

17. A process according to claim 16 in which the polymer is an anionic polymer made from a water soluble blend of non-ionic ethylenically unsaturated monomer and ethylenically unsaturated carboxylic monomer in an amount of 5 to 20% by weight of total monomers and has intrinsic viscosity of about 2 to about 16 dl/g.

18. A process according to claim 1 in which the metal ore is selected from iron ore and titanium-bearing ores, the total amount of water in the moist pelletisable mixture is 5 to 15% by weight, and the pelletisation is by tumbling, rolling or balling followed by baking.

* * * * *